US005324902A

United States Patent [19]

Shen

[11] Patent Number: 5,324,902

[45] Date of Patent: Jun. 28, 1994

[54] MECHANICAL KEY SWITCH FOR A MEMBRANE KEYBOARD

[76] Inventor: Chen T. Shen, No. 1, Lane 9, Fu-An 3 St., Chung Li City, Taiwan

[21] Appl. No.: 79,046

[22] Filed: Jun. 21, 1993

[51] Int. Cl.[5] ..... H01H 29/16

[52] U.S. Cl. ..... 200/517; 200/516; 200/520; 200/521

[58] Field of Search ..... 200/517, 516, 512, 520, 200/521, 535, 408, 409, 345

[56] References Cited

U.S. PATENT DOCUMENTS 4,241,960 12/1980 Hentschel ..... 384/297
4,864,085 9/1989 Hanajima et al. ..... 200/517
5,012,055 4/1991 Matsui ..... 200/517

*Primary Examiner*—Henry J. Recla
*Assistant Examiner*—David J. Walczak

[57] ABSTRACT

A mechanical key switch for a membrane keyboard including a key cap supported on an actuating spring member by a compression spring and made to slide on a key body vertically, the actuating spring member having a unitary, arched bridge plate in the middle, which curves inwards to trigger an electrical signal and simultaneously to produce a click sound upon pressing of the key cap against the compression spring, and curves outwards to return the key cap and simultaneously to produce a click sound upon releasing of the key cap.

1 Claim, 2 Drawing Sheets

MECHANICAL KEY SWITCH FOR A MEMBRANE KEYBOARD

BACKGROUND OF THE INVENTION

The present invention relates to key switches and more specifically to a mechanical key switch for a membrane keyboard which produces a click sound each time it is switched on or switched off.

A variety of mechanical key switches are known, and used in computer keyboards for triggering signals. These mechanical key switches are commonly consisted of at least six component parts. Therefore, the conventional mechanical key switches are complicated to assemble, and expensive to manufacture.

SUMMARY OF THE INVENTION

One object of the present invention is to provide a mechanical key switch for a membrane keyboard which is consisted of less number of component parts. Another object of the present invention is to provide a mechanical key switch for a membrane keyboard which is inexpensive to manufacture, and easy to assemble. Still another object of the present invention is to provide a mechanical key switch for a membrane keyboard which is durable in use. Still another object of the present invention is to provide a mechanical key switch for a membrane keyboard which produces a click sound each time it is switched on or switched off.

According to the preferred embodiment of the present invention, the mechanical key switch is consisted of a key body, an actuating spring member, a compression spring, and a key cap. The compression spring is supported between the key cap and the actuating spring member inside the key body, and pressed by the key cap to squeezed the actuating spring member causing it to deform and simultaneously to trigger an electrical signal. The actuating spring member comprises a unitary, arched bridge plate in the middle, on which the compression spring is supported. As the compression spring is compressed by the key cap, the bridge plate is forced to curve inwards in producing a click sound and in triggering the circuit membrane assembly below. As the key cap is released, the bridge plate returns to its former shape, and simultaneously produces a click sound.

DETAILED DESCRIPTION OF THE PREFERRED EMBODIMENT

Figure 1:
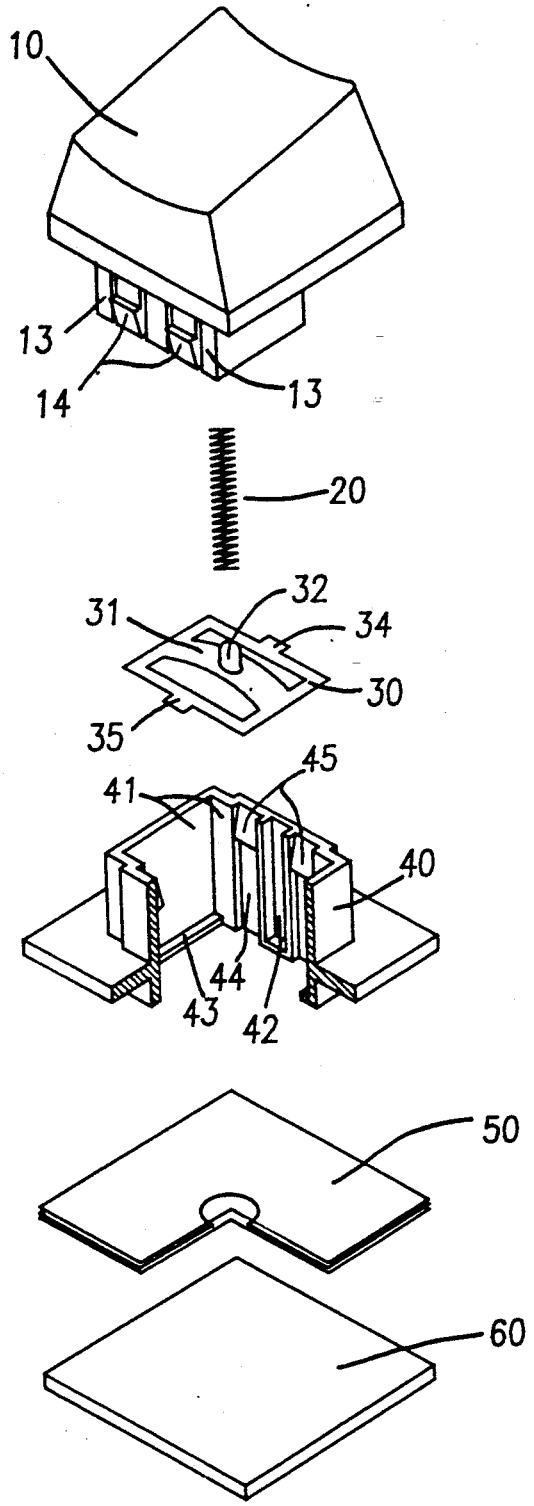
FIG. 1 is a perspective exploded view of a mechanical key switch constructed according to the preferred embodiment of the present invention.
Figure 2:
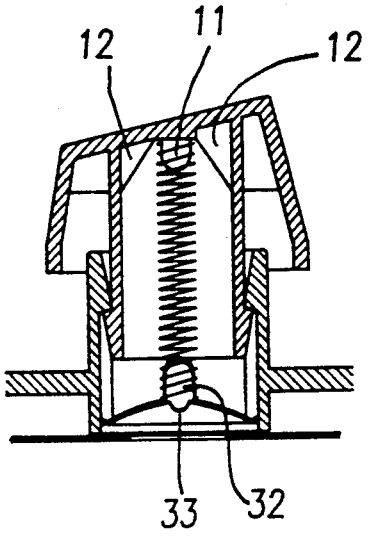
FIG. 2 is a sectional elevational view of the key switch of FIG. 1 when assembled.

Referring to FIGS. 1 and 2, a mechanical key switch constructed in accordance with the present invention is generally comprised of a key cap 10 supported on an actuating spring member 30 by a compression spring 20 and made to slide on a rectangular key body 40 vertically. The key cap 10 comprises a circular stub rod 11 on the inside in the middle, two flat, rectangular slide rails 13 vertically extended downwards, bevel ribs 12 sloping downwards and outwards around the circular stub rod 11 and the slide rails 13 and respectively sloping downwards and outwards from the circular stub rod

11 toward the slide rails 13, and opposite pairs of hooks 14 disposed between the slide rails 13. The bevel ribs 12 are to guide the compression spring 20 in position upon pressing of the key cap 10. The actuating spring member 30 is made from a plastic coated spring plate, comprising a unitary, arched bridge plate 31 in the middle, which has a top projecting portion 32 at the top and a bottom projecting portion 33 at the bottom, and two opposite mounting projections 34; 35 at two opposite sides relative to the bridge plate 31. The rectangular key body 40 has a rectangular opening comprised two sliding ways 41 therein, in which the slide rails 13 of key cap 10 slide respectively, two opposite mounting grooves 42 in the middle of two sliding ways, which receive the mounting projections 34; 35 of the actuating spring member 30 respectively, inward bottom flanges 43, which limit the down stroke of the slide rails 13, opposite pairs of sliding grooves 44 respectively disposed between the mounting grooves 42 and the sliding ways 41, opposite pairs of bevel blocks 45 above the sliding grooves 44, which guide the hooks 14 of the key cap 10 into the sliding grooves 44. Once the hooks 14 have been respectively guided into the sliding grooves 44, they become stopped within the sliding grooves 44 by the bevel blocks 45. The compression spring 20 has a top end mounted on the circular stub rod 11, and a bottom end supported on the top projection 32 of the bridge plate 31 of the actuating spring member 30.

Referring to FIGS. 1 and 2 again, the key body 40 is mounted on the upper circuit membrane 50 above the lower circuit membrane 60 to support the key cap 10. The actuating spring member 30 is fastened inside the key body 40 above the circuit membrane 50 by engaging the mounting projections 34; 35 into the mounting grooves 42 respectively. The key cap 10 is vertically slidably mounted on the key body 40 at the top with its slide rails 13 respectively inserted into the sliding ways 41, and with its hooks 14 respectively engaged into the sliding grooves 44. The compression spring 20 is supported between the circular stub rod 11 of the key cap 10 and the top projection 32 of the actuating spring member 30.

Figure 3:
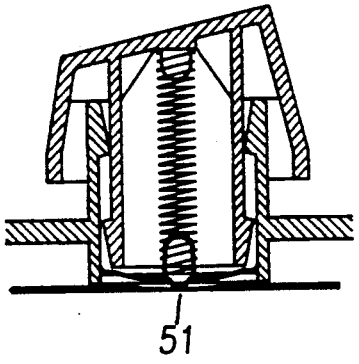
FIG. 3 is similar to FIG. 2 but showing the key switch pressed.

Referring to FIG. 3, as the key cap 10 is pressed, the compression spring 20 is compressed to give a pressure to the bridge plate 31 of the actuating spring member 30, causing the bridge plate 31 to curve downwards and simultaneously to produce a click sound when deformed, and therefore the bottom projecting portion 33 forces the contact 51 on the upper circuit membrane 50 to contact the corresponding contact on the lower circuit membrane 60 in producing an electrical signal. As the key cap 10 is released, the bridge plate 31 of the actuating spring member 30 and the compression spring 20 are respectively and immediately return to their former shapes in pushing back the key cap 10. Each time the bridge plate 31 is returned from the deformed shape to its former shape, a click sound is simultaneously produced. When returned, the key cap 10 will not escape from the key body 40 because the hooks 14 are respectively hooked on the bevel blocks 45.

As indicated, the key switch is consisted of only four elements, namely, the key body, the actuating spring member 30, the compression spring 20, and the key cap 10, therefore its structure is simple. Because the switching operation of the actuating spring member 30 is driven by the key cap 10 through the compression spring 20, less effort is needed. Further, a click sound will be produced each time the key switch is switched on or off.

What is claimed is:

1. A mechanical key switch for a membrane keyboard comprising:

a rectangular key body having first and second opposed walls, third and forth opposed walls, and a rectangular opening comprised of two opposite sliding ways located respectively on said first and second opposed walls, two opposite mounting grooves located respectively on said third and forth opposed walls, an inward bottom flange located at a bottom portion of each said first and second opposed walls, a pair of sliding grooves disposed on each of said third and forth opposed walls and positioned such that said mounting groove on said third wall lies between said pair of sliding grooves on said third wall and said mounting groove on said forth wall lies between said pair of sliding grooves on said forth wall, and a bevel block located above each sliding groove;

a key cap slidably mounted on said key body, comprising a circular stub rod centrally disposed within said key cap, two flat, rectangular slide rails respectively inserted in said sliding ways inside said key body a plurality of, bevel ribs sloping downwards and outwards around said circular stub rod, and opposite pairs of hooks vertically extending between said slide rails wherein each hook is guided by a respective bevel block of said key body and into a respective sliding groove and slidably stopped in said sliding groove by said bevel block;

an actuating spring member adapted to overlie a switching membrane and made from a plastic coated spring plate and horizontally fastened inside said key body, comprising a unitary, arched bridge plate, and two opposite mounting strips secured to said bridge plate at two opposite sides thereof wherein said mounting strips are respectively engaged into said mounting grooves on said key body, said bridge plate having a top projecting portion at a top center of the arch and a bottom projecting portion beneath the center of the arch; and a compression spring having a top end mounted on said circular stub rod of said key cap, and a bottom end supported on said top projection of said bridge plate;

whereby pressing said key cap causes said bridge plate to curve inwards causing said bottom projection to actuate the switching membrane and simultaneously in producing a click sound and whereby; releasing said key cap causes said bridge plate to return to its former shape while pushing back said key cap and simultaneously producing a click sound.

* * * * *